US006024247A

United States Patent [19]

Birr

[11] Patent Number: 6,024,247

[45] Date of Patent: Feb. 15, 2000

[54] DEBLISTERING MACHINE

[75] Inventor: Geoffrey Charles Birr, Grimsby, Canada

[73] Assignee: Apotex Inc., Weston, Canada

[21] Appl. No.: 08/998,649

[22] Filed: Dec. 29, 1997

Related U.S. Application Data

[60] Provisional application No. 60/034,747, Jan. 10, 1997.

[51] Int. Cl.[7] ..... B65H 3/58; B65H 5/28

[52] U.S. Cl. ..... 221/26; 221/30; 221/72; 221/74

[58] Field of Search ..... 221/26, 30, 31, 221/32, 72, 74, 79, 80, 88

[56] References Cited

U.S. PATENT DOCUMENTS 4,316,565 2/1982 Swette ..... 271/274
4,733,797 3/1988 Haber ..... 221/31 X
5,860,561 1/1999 Saldana et al. ..... 221/72 X

*Primary Examiner*—William E. Terrell
*Assistant Examiner*—Gene O. Crawford

[57] ABSTRACT

Solid dosage forms of pharmaceuticals, e.g. tablets, may be removed from blister packs with a deblistering machine. The machine has a roller and a stationary plate. The roller has a longitudinal axis of rotation and means for rotating the roller about the axis. The roller has an inner core and a cover thereon with a non-slip surface. The stationary plate has at least as many slots as there are columns of blisters, and each of the slots has a width parallel to the rotational axis of the roller, the width of each slot being at least as large as the width of a blister. Each of the slots has a length transverse to the slot's width and is at least as large as the length of a blister. The plate is situated to provide a throat, between the cover and the plate, into which the blister pack may be fed and through which the blister pack may pass as a result of rotation of the roller. The plate has a guide to ensure that each column of blisters is aligned with corresponding slots.

4 Claims, 3 Drawing Sheets

DEBLISTERING MACHINE

This application claim benefit of Provisional application Ser. No. 60/034,747 Jan. 10, 1997.

FIELD OF THE INVENTION

The present invention relates to a machine for removing a plurality of solid dosage forms, e.g. tablets, or capsules, of pharmaceuticals, vitamins, minerals or similar from blister packages. Such a machine is sometimes referred to as a deblistering machine.

BACKGROUND TO THE INVENTION

Pharmaceuticals are often made available in tablets or capsules. One form of packaging commonly used is a so-called blister pack. In such a blister pack, there are a plurality of blisters, usually made by thermoforming a polymeric film. In each blister there may be one or more tablets. The tablets are retained in the blister by means of a foil which is adhered to the blistered film. Sometimes, the blister pack also has a printed card adhered to the blister film. In use, a person will release a tablet from a blister by gripping the blister pack and pushing upon the blister with a thumb until the tablet is forced through the foil backing.

In some jurisdictions, when a blister pack is not fully utilized, i.e. not all of the tablets are used, the tablets must be removed from the blister pack and destroyed. In other jurisdictions, the tablets may be removed from the blister pack and recovered. In any event, the tablets need removing from the blister pack.

It is common in hospitals and nursing homes for there to be a substantial number of blister packs which need to be emptied of tablets. This occurs, for example, when a patient dies and the tabletted medication is no longer needed. In such instances, one of the staff at the hospital or nursing home must "pop" the tablets out of the blister packs. The process is labour intensive and causes pain to the thumb of the person who is "deblistering" the tablets. Indeed, in cases where relatively large volumes of tablets need to be deblistered, there may be injury to the thumb and hand.

A number of attempts have been made to make machinery which performs the task of deblistering. One such machine attempts to emulate the manual removal of tablets by providing a support for the back of the blister pack and replacing the thumb with a rod or pin. In order to make such a machine practically useful, a plurality of pins are used. Such machine uses a perforated first plate in which the perforations correspond to the positioning of the blisters on a particular blister pack. A plurality of pins which protrude from a second plate are located to pass through corresponding perforations in the first plate. The blister pack is placed on the perforated plate and the pins are brought into contact with the blisters in an attempt to punch the tablets through the perforations. It has been found, however, that such machines intended to deblister more than about 10 blisters require unreasonable force to be applied to the plate with the pins, even when the pins have sharp ends to reduce the surface area of contact with the blisters.

Another machine, sold under the trade mark PRESS-OUT uses two motor-driven counter-rotating rollers. The rollers, which in longitudinal cross-section appear castellated, mesh with one another. The distances between the peaks and valleys of the castellation are determined by the distances between columns of blisters and the diameter of each blister. Such a machine requires a large number of sets of machined rollers to accommodate the different styles of blister packs.

In addition, such machine is very expensive to make and purchase. Its expense makes it available only to the largest nursing homes and hospitals.

There is a need for a simple inexpensive machine, which can be operated by one person, without having to exert a lot of strength. There is also a need for a machine which is portable and, for example, can be taken from nursing home to nursing home. The present invention addresses these needs.

The terms "solid dosage form" as used herein includes tablets or capsules of pharmaceuticals.

SUMMARY OF THE INVENTION

The present invention provides a deblistering machine for expelling solid dosage forms from a blister pack which comprises at least one column of blisters, each blister having a width transverse to the direction of the column and a length parallel to the direction of the column, said deblistering machine comprising:

(a) a roller having a longitudinal axis of rotation and means for rotating said roller about the axis, said roller having an inner core and a cover thereon with a non-slip surface; and (b) a stationary plate having a thickness, a width parallel to the direction of the roller axis and a length transverse to the plate width, said plate having at least as many slots as there are columns of blisters, each of said slots having a width parallel to the rotational axis of the roller and the width of the slot being at least as large as the width of a blister, each of said slots also having a length transverse to the slots width and being at least as large as the length of a blister, said plate being situated to provide a throat between the cover and the plate into which the blister pack may be fed and through which the blister pack may pass as a result of rotation of the roller, said plate having a guide to ensure that each column of blisters is aligned with corresponding slots.

In one embodiment, each slot has a tine associated therewith, wherein the tine protrudes through the slot from a side distal to the roller, and a tip of said tine is slightly proud of a plane passing through a face of the slotted plate, said face being adjacent to the roller.

In another embodiment, the roller is manually rotatable.

In a further embodiment, the cover has a hardness of between 40 and 80 Durometer hardness and a thickness of between 2 mm and 5 mm, especially between 3 mm and 3.5 mm.

In yet another embodiment, the deblistering machine has a clamp for clamping the machine to a table top.

DETAILED DESCRIPTION OF PREFERRED EMBODIMENTS

Figure 1:
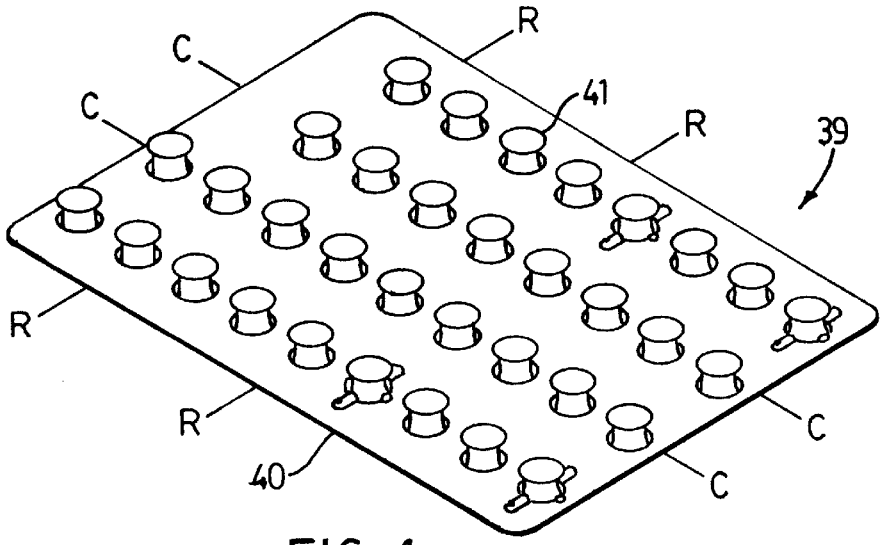
FIG. 1 is a view of a blister pack which may be deblistered with a deblistering machine of the present invention.

A blister pack suitable for use with the present invention is shown in FIG. 1. When first prepared, a blister pack 39 usually comprises a plurality of rows R and columns C of blisters 41. Solid dosage forms, for example tablets, gel capsules or the like, are located inside blisters 41. They are held in place by foil backing 40 which is adhered to the back of the blistered film. Although not shown in the drawings, the blister pack may also have a card face or backing with information thereon. Blister packs come in a large variety of configurations. For example, one blister pack may have seven rows and five columns; another may have nine rows and four columns.

Figure 2:
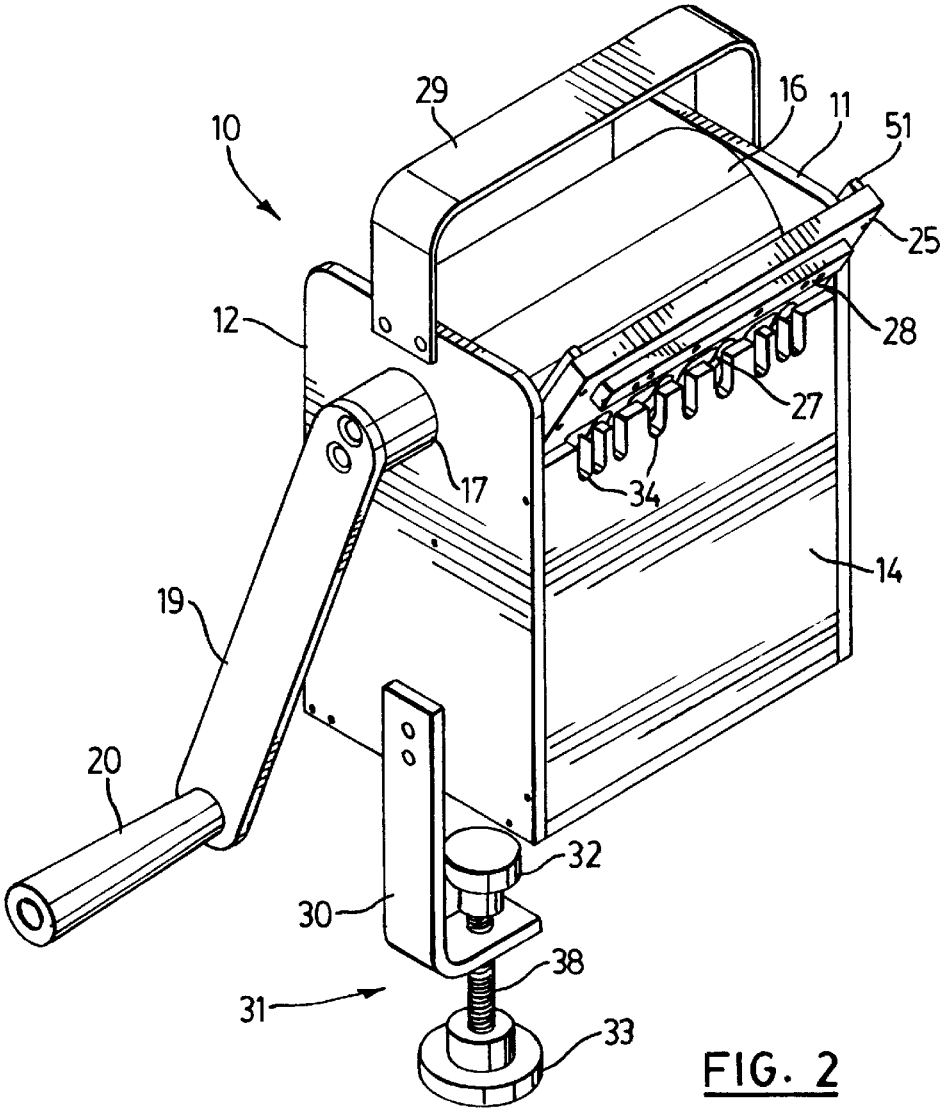
FIG. 2 is a three-quarter rear view of a portable deblistering machine of the present invention.
Figure 3:
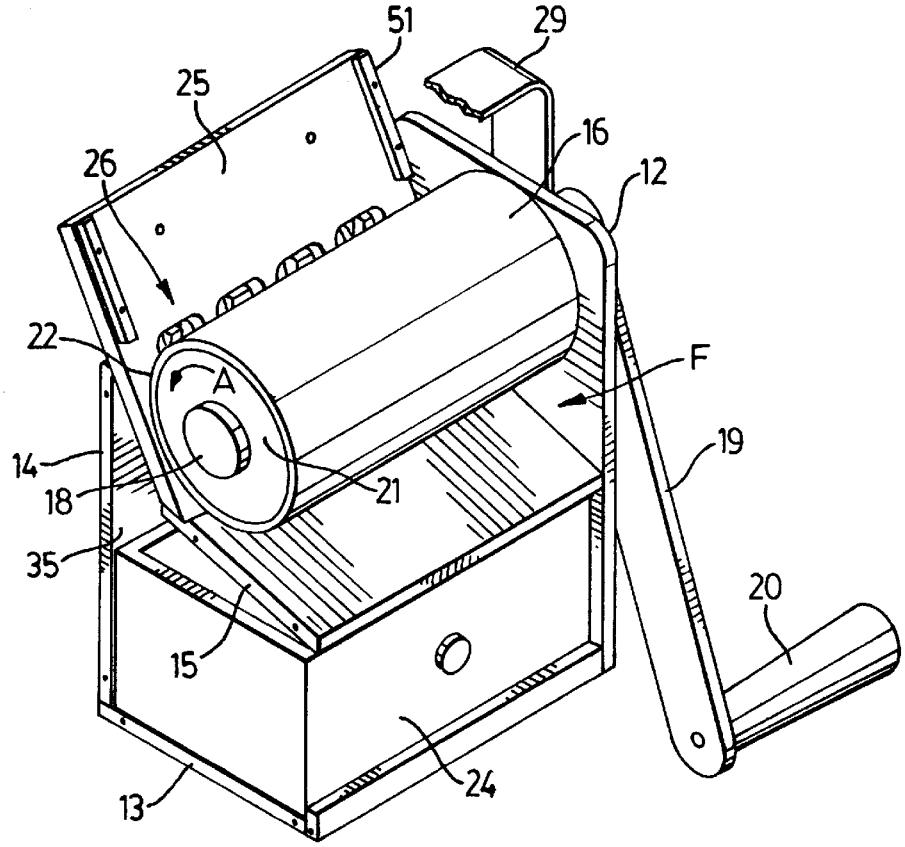
FIG. 3 is a cut-away three quarter front view of the deblistering machine of FIG. 2.
Figure 4:
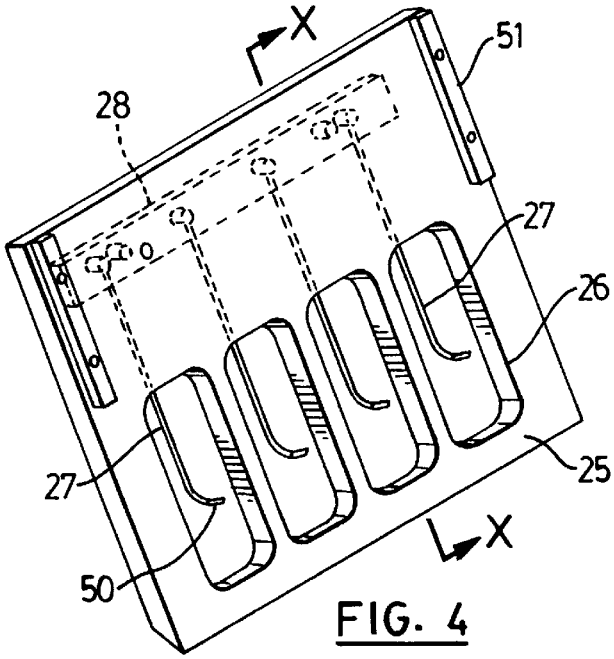
FIG. 4 is a three-quarter view of a preferred slotted plate used in the present invention.
Figure 5:
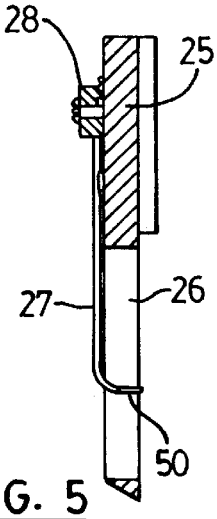
FIG. 5 is a cross-sectional view through lines X—X in FIG. 4.

A portable embodiment of a deblistering machine 10 is shown in FIGS. 2 and 3. The deblistering machine 10 has two vertical end plates 11 and 12 which are separated by a back plate 14 and base plate 13. In addition, there is a stop plate 15 which is secured between end plates 11 and 12. Stop plate 15 slopes downwardly towards the front F of deblistering machine 10. Base plate 13, back plate 14 and stop plate 15 are secured to end plates by bolts (not shown).

There is sufficient room between base plate 13 and stop plate 15 for insertion of a drawer 24 which rests on base plate 13. Back plate 14 may have vertically inclined slots 34 in the top edge. Such slots are not necessary but are preferred in some instances. The purpose of such slots will be explained more fully hereinafter.

A roller 16 is journalled in plates 11 and 12 with axle 18 of roller 16 being rotatable in holes 17 in plates 11 and 12. One end of axle 18 is connected to crank 19 and handle 20. Roller 16 may be rotated manually by rotating crank 19 with handle 20. Crank 19 and handle 20 may be replaced by an electrical motor or other turning mechanism. Roller 16 comprises a hard core 21 and a cover 22. Typically axle 18 and core 21 are integral with one another and are made of the same material. Typically the core is of metal or plastic such as DELRIN (trade mark) acetal resin, available from E.I. du Pont de Nemours and Company. The cover 22 is a resilient material with a non-slip surface, i.e. has a surface with a high coefficient of friction, as will be described in more detail hereinafter.

The tops of end plates 11 and 12 are connected by handle 29. The handle 29 allows easy carrying of deblister machine 10. At the bottom of plate 12 there is attached a clamping device which comprises angle bracket 30, which depends from plate 12, and screw clamp 31. Screw clamp 31 comprises a threaded rod 38 which passes through a threaded hole in angle bracket 30. The lower end of threaded rod 38 has a knob 33 and the other end has a clamping disc 32.

The clamping device is intended to allow the portable deblistering machine 10 to be clamped to the top of a table, desk or similar support. The clamping device is not essential but assists in holding deblistering machine 10 steady when the deblistering process is underway. If desired the deblistering machine 10 may be permanently mounted on a desk or similar surface, or may be temporarily held by hand.

A slotted plate 25 is held between end plates 11 and 12. The slotted plate 25 is removably held in place by guides (not shown). Slotted plate 25 has guides 51 for guiding a blister pack over plate 25. As will be seen more clearly in FIG. 6, the face of slotted plate 25 which faces cover 22 of roller 16 is in close proximity to cover 22 but not in contact therewith. The minimum distance between cover 22 and roller 16 is dictated mostly by the thickness of film, foil and card used to make the blister pack, and also by the thickness and hardness of cover 22. For example, with a film, foil and card with a thickness of 1.27 mm, and a 3.2 mm thick 60 Durometer hardness rubber cover, a suitable gap between the cover and the slotted plate is about 0.76 mm. Slotted plate 25 has a plurality of elongated slots 26 therein. Secured to the rear face of slotted plate 25 are a plurality of tines 27. Tines 27 are attached to slotted plate 25 by screw clamps 28. The end of each tine 27 is curved into elongated slot 26. The tine 27 goes through elongated slot 26 so that, at rest, the tip 50 of tine 27 is proud of the plane through the front face of slotted plate 25, i.e. tip 50 is slightly closer to roller 16 than is the plane through the front face of slotted plate 25.

In some instances, it may be desirable to have slotted plates 25 which are especially designed for a particular type of blister pack. For example, with blister packs which have large tablets therein, the space between slotted plate 25 and cover 22 may need to be larger than would be the case for a similar blister pack with small tablets. In such an instance, the thickness of the slotted plate is selected to provide optimum deblistering performance for a particular type of blister pack. Alternatively of course, the slotted plate 25 could remain the same for most blister packs, but rollers 16 of different diameters could be selected to achieve optimum deblistering performance.

In order to deblister a blister pack with "n" columns of blisters, it is necessary to select a slotted plate 25 with "n" elongated slots 26. For example, for a blister pack with six columns, it is necessary to select a slotted plate 25 with six elongated slots 26. In the embodiment shown in FIG. 3, slotted plate 25 has four elongated slots 26 and is suitable for deblistering a four-column blister pack.

Figure 6:
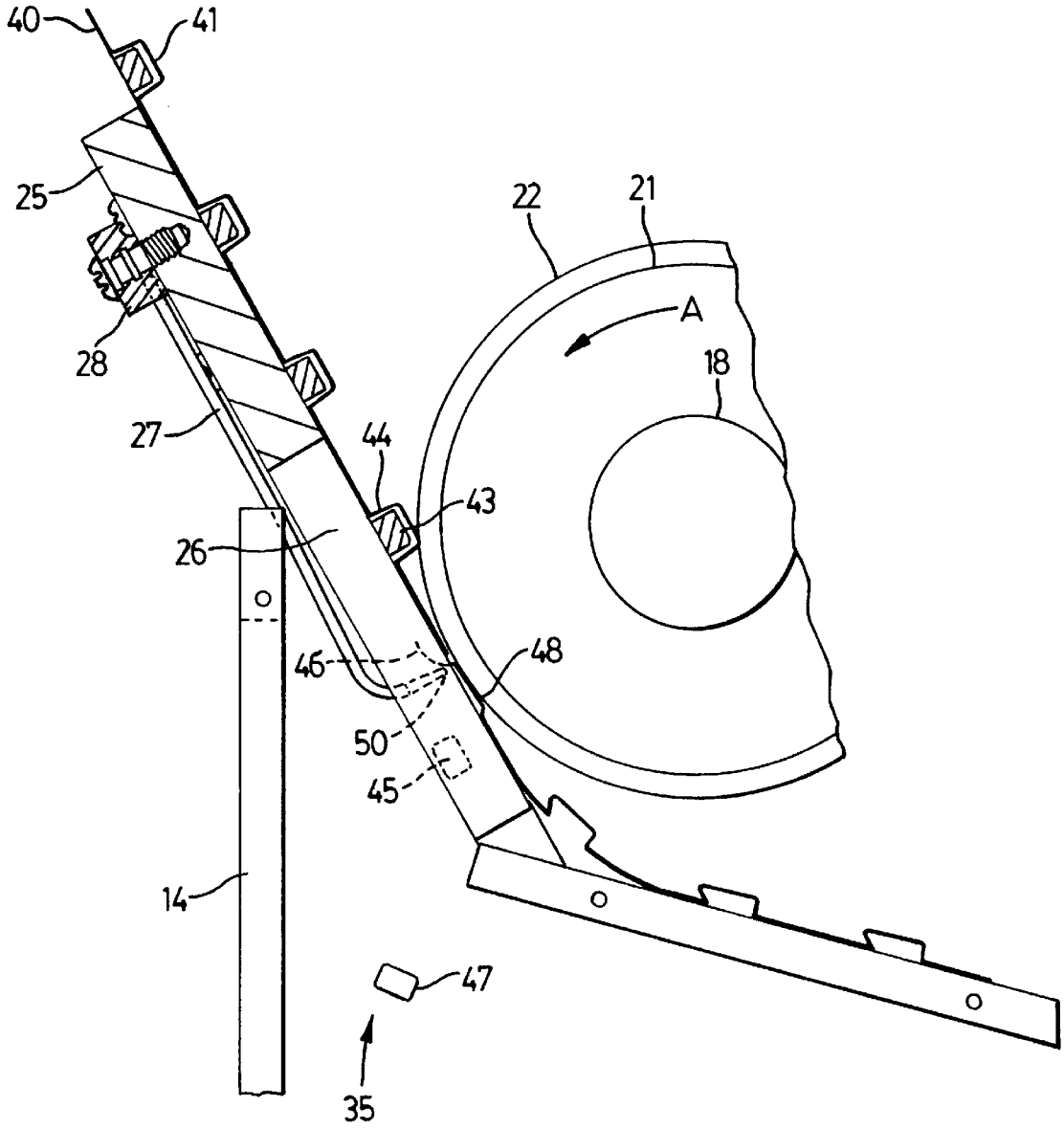
FIG. 6 is a cross-sectional view of a roller and slotted plate, illustrating the operation of the deblistering machine of FIGS. 2 and 3.

As will be more easily understood by reference to FIGS. 2 and 6, in order to deblister a blister pack, the deblistering machine 10 is first clamped to a table top or similar by means of the clamping device 31, i.e. by rotating knob 33 in order to screw clamping disc 32 in contact with the underside of the table top, thus trapping the table top between clamping disc 32 and bottom plate 13. A slotted plate 25 is selected, suitable for the blister pack which is to be deblistered. The blister pack is fed between guides 51 into the throat between slotted plate 25 and roller 16, with the foil backing 40 of the blister pack being in contact with the front face of slotted plate 25. Roller 16 is rotated in the direction indicated by arrow A by means of turning handle 20. As the minimum distance between the slotted plate 25 and roller 16 is slightly less than the thickness of the total thickness of the blister film, foil backing and any associated card, and as the cover 22 is of a material suitable for gripping the blister pack, blister pack 39 is pulled into the gap between slotted plate 25 and roller 16. When a blister, e.g. blister 44 comes in contact with cover 22, roller 16 presses upon blister 44 and starts to crush the top of blister 44. In so doing, the top of blister 44 presses against tablet 43, thus putting pressure on the foil backing 40. The foil backing 40 is thus caused first to bulge and then to break as the blister 44 is drawn further into the narrowing gap between slotted plate 25 and roller 16. When the blister reaches the narrowest point between slotted plate 25 and roller 16, as shown at crushed blister 48 the tablet 45 is pushed through the broken foil. Tablet 45 then passes through slot 26 and falls under gravity through gap 35 (at a position shown by tablet 47) which is between back plate 14 and stop plate 15, into tray 24.

For tablets which substantially fill a blister or for tablets which are relatively large, it has been found that the tablets tend to break through the foil backing, be expelled, and drop away under gravity without further assistance. In such instances all or substantially all of the tablets in a blister pack will be deblistered. For small tablets, or tablets which do not substantially fill the blister, such tablets may be prevented or impeded from fully being expelled from the blister by edges of the broken foil catching on the tablet. In such instances, it may be necessary to assist in the removal, preferably by opening the hole in the foil backing or stripping part of the foil backing away. The tines 27 are adapted to so assist removal of tablets from the blister. As foil backing 40 is broken, the tip 50 of tine 27 catches an edge of the broken foil, and as the blister pack is pulled past the tip 50, the foil backing is peeled back, as shown at position 46 in FIG. 6. This assists in the expulsion of tablet 45 from the now-crushed blister. The tablets then drop into tray 24 from where they may be recovered.

It will be understood that tray 24 may be replaced by a chute so that the tablets are directed into a container for recovered tablets. When deblistering small tablets, especially with the assistance of tines 27, there is sometimes a tendency for the tablets to "jump" upwards. In order to prevent their escape over the top of back plate 14, back plate 14 should extend as high as possible but not interfere with the operation of the tines. Slots 34 accommodate tines 27. For convenience, it is not desirable to be changing back plate 14 every time there is a change in slotted plates 25, e.g. to accommodate a 4-slot plate and then a 6-slot plate. Therefore the spacing of slots 34 will preferably accommodate the spacings of tines on several different slotted plates 25. Alternative arrangements may be made to prevent escape of tablets over the top of back plate 14. For example, the top may be made from a flexible material such as an elastomeric sheet, which will form a wall which is flexible enough to deform around the top of the tines. Another arrangement may be a plurality of filaments extending upwardly from the top of the back plate 14 to form a brush-like curtain.

While the deblistering machine may be made from any suitable materials, for pharmaceuticals, vitamins, minerals or similar materials, the body of the machine should be made from food grade materials such as coated aluminium or stainless steel. The roller 16 may be metal, but for economy of weight and cost, a tough polymeric resin such as an acetal resin is preferred. In addition to having sufficient surface traction to grip the blister back and pull it into the throat and nip between roller 16 and slotted plate 25 the cover 22 has sufficient hardness to press against a blister and depress it in order to expel a tablet. The cover may be hard, like a knurled metal surface, but preferably has some resiliency.

Typically useful materials for the cover are rubbers, either natural or synthetic, especially vulcanized rubbers having Durometer hardnesses between about 40 and 80. Such materials also have a sufficiently high coefficient of friction to pull the blister pack into the throat of the deblistering machine without slippage.

The tines may be made of stainless spring steel. The ends of the tines are bent in such a way as to pick at the foil and then strip it out of the way as the blister passes the tine.

It will be understood that in order to accommodate different blister arrangements, several perforated plates 25 will be required. A four-perforation perforate plate is needed for four-column blisters; a six-perforation plate is needed for six-column blisters, and so on. Additionally, there may need to be means to adjust the distance in the throat between the roller 16 and perforated plate 25 in order to accommodate blister packs of different thicknesses. For example, a blister pack without card requires a narrower throat than if the blister pack has a card. Clearly, the gap may be altered by having rollers 16 of different diameters, plates 25 of different thickness, or means to move the roller 16 and plate 25 closer together, e.g. set screws, levers and the like, as will be apparent to those skilled in the art.

In a first experiment, a deblistering machine had a roller 16 having core of about 8 cm diameter, covering with a 3 mm thick rubber sheet having a Durometer hardness of 60. The gap between plate 25 and roller 16 was about 0.76 mm. With blister packs, with either large or small tablets, made of 1.27 mm thick film and foil backing, all of the tablets were expelled from the blister packs.

In a second experiment, a roller made from a core of acetal, about 5.08 cm diameter was covered with 19 mm thick rubber sheet having a Durometer hardness of 40. Large tablets in blister packs were expelled as well as in the first experiment, but the deblistering machine was not as efficient when there were small tablets in the blister packs.

In the event that the deblistering machine jams, it is an easy matter to counter-rotate the roller 16. This permits the blister pack to be removed from the throat between the roller 16 and slotted plate 25. If the slotted plate is held in place merely by guides, counter-rotation of roller 16 may lift slotted plate 25, thus aiding in the removal of the blister pack.

I claim:

1. A DEBLISTERING machine for expelling solid dosage forms from a blister pack which comprises at least one column of blisters, each blister having a width transverse to the direction of the column and a length parallel to the direction of the column, said deblistering machine comprising:

(a) a roller having a longitudinal axis of rotation and means for rotating said roller about the axis, said roller having an inner core and a cover thereon with a non-slip surface;

(b) a stationary plate having a thickness, a width parallel to the direction of the roller axis and a length transverse to the plate width, said plate having at least as many slots as there are columns of blisters, each of said slots having a width parallel to the rotational axis of the roller and the width of the slot being at least as large as the width of a blister, each of said slots also having a length transverse to the slots width and being at least as large as the length of a blister, said plate being situated to provide a throat between the cover and the plate into which the blister pack may be fed and through which the blister pack may pass as a result of rotation of the roller, said plate having a guide to ensure that each column of blisters is aligned with corresponding slots; and (c) a tine associated with each slot, wherein the tine protrudes through the slot from a side distal to the roller, and a tip of said tine is slightly proud of a plane passing through a face of the slotted plate, said face being adjacent to the roller.

2. A deblistering machine according to claim 1 wherein the roller is manually rotatable.

3. A deblistering machine according to claim 1 wherein the cover has a hardness of between 40 and 80 Durometer hardness and a thickness of between 2 mm and 5 mm.

4. A deblistering machine according to claim 1 wherein the deblistering machine has a clamp for clamping the machine to a table top.

* * * * *